United States Patent [19]

Lindholm

[11] Patent Number: 5,054,401

[45] Date of Patent: Oct. 8, 1991

[54] DEVICE FOR THE CLEANING OF RAILS BY SCRAPING, LOOSENING, AND BRUSHING

[75] Inventor: Olof Lindholm, Uttran, Sweden

[73] Assignee: AB Mahler & Soner, Rosson, Sweden

[21] Appl. No.: 435,413

[22] PCT Filed: May 5, 1988

[86] PCT No.: PCT/SE88/00234

§ 371 Date: Nov. 9, 1989

§ 102(e) Date: Nov. 9, 1989

[87] PCT Pub. No.: WO88/08900

PCT Pub. Date: Nov. 17, 1988

[30] Foreign Application Priority Data

May 11, 1987 [SE] Sweden ..... 8701932

[51] Int. Cl.[5] ..... B61F 19/00

[52] U.S. Cl. ..... 104/279; 15/55

[58] Field of Search ..... 104/279; 15/4, 54, 55

[56] References Cited

U.S. PATENT DOCUMENTS

| | | | |
|---|---|---|---|
| 414,511 | 11/1889 | Fisher | 104/279 |
| 469,103 | 2/1892 | Taylor | 104/279 |
| 573,511 | 12/1896 | Grunow | 104/279 |
| 626,039 | 5/1899 | Robertson . | |
| 701,795 | 6/1902 | Chamberlin et al. | 15/55 |
| 793,924 | 7/1905 | Presser | 104/279 |
| 2,042,029 | 5/1936 | Smith | 104/279 |
| 2,505,501 | 4/1950 | Miller et al. . | |
| 3,004,273 | 10/1961 | Rushmer | 15/55 |
| 4,062,295 | 12/1977 | Hamann | 104/279 |

FOREIGN PATENT DOCUMENTS

| | | | |
|---|---|---|---|
| 138080 | 4/1901 | United Kingdom . | |
| 959106 | 1/1956 | Fed. Rep. of Germany . | |
| 2174630 | 11/1986 | United Kingdom | 104/279 |

*Primary Examiner*—Matthew C. Graham
*Assistant Examiner*—S. Joseph Morano
*Attorney, Agent, or Firm*—Cushman, Darby & Cushman

[57] ABSTRACT

For cleaning the top surfaces of railway rails, a vehicle (1) carried on rails, and has scrapers, looseners, and rotatable brushes. In case of wet rail, the scrapers are used to make the top surfaces of the rails dry. The looseners are used to loosen up encrustments located on the top surfaces of the rails after which the encrustments are removed by the aid of the brushes means from the top surfaces of the rails (4). The scrapers and the looseners are carried by slewing brackets connected with the chassis of the vehicle and the brushes are carried by telescopic supports connected to the chassis of the vehicle. The scrapers, looseners and brushes are operable between an inactive position of repose and an active working position. The vehicle it can be used for cleaning of rails in both directions of travel.

10 Claims, 3 Drawing Sheets

DEVICE FOR THE CLEANING OF RAILS BY SCRAPING, LOOSENING, AND BRUSHING

BACKGROUND OF THE INVENTION

This invention relates to a method and a device for cleaning the top surfaces of rails.

In connection with leaves and other parts of plants falling down on railway rails, a problem difficult to master will arise. The leaves and the other particles contribute to a lubricating film being formed on the rail with the result that the tractive ability of a locomotive is reduced due to skidding between the drive wheels of the locomotive and the contact surface of the rail arising. As a consequence of this it may be necessary to double the locomotive to manage propulsion of a certain train set. Due to leaves and particles covering the tread surface of the rail the braking distance of the train set will also increase. There is also a risk that the wheels of the locomotive and the trucks will lock in braking, with the result that the tread surfaces of the wheels will be partially flattened out and consequently destroyed, the consequence unfortunately being, in turn, that expensive and time-consuming repairing measures must be taken.

Thus, there is a need to achieve cleaning of the tread surface of the rail in an efficient manner.

SUMMARY OF THE INVENTION

It is the object of this invention to provide a method and a device for cleaning the tread surface of the rail efficiently.

BRIEF DESCRIPTION OF THE DRAWING

Illustrative examples of the invention will be described in greater detail below with reference to the attached drawings, in which.

DETAILED DESCRIPTION

Figure 1:
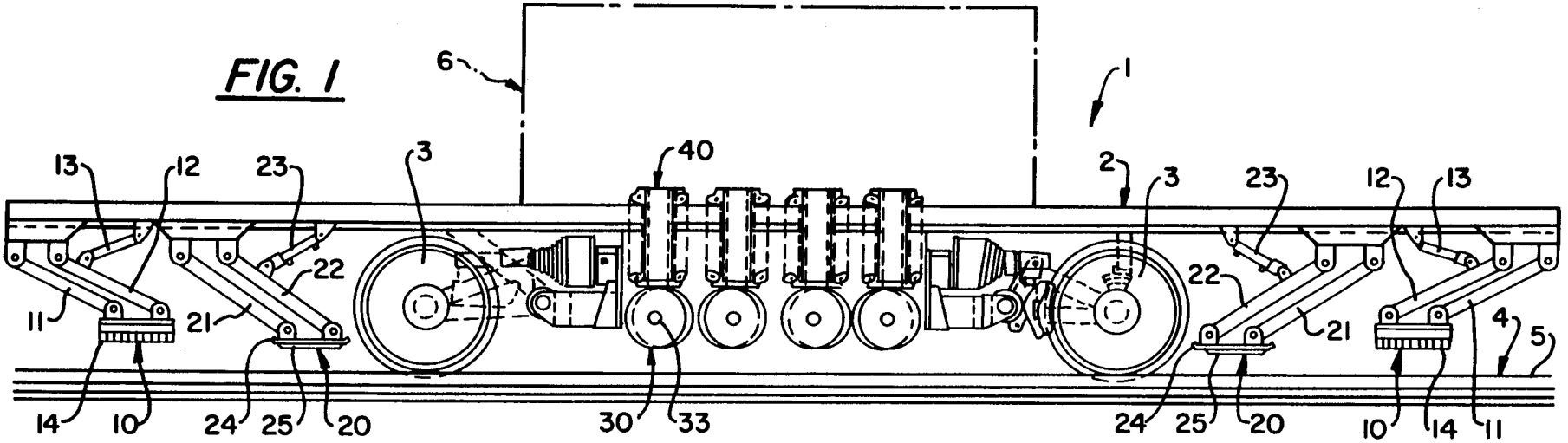
FIG. 1 is a schematic lateral view of a device according to the invention.
Figure 4:
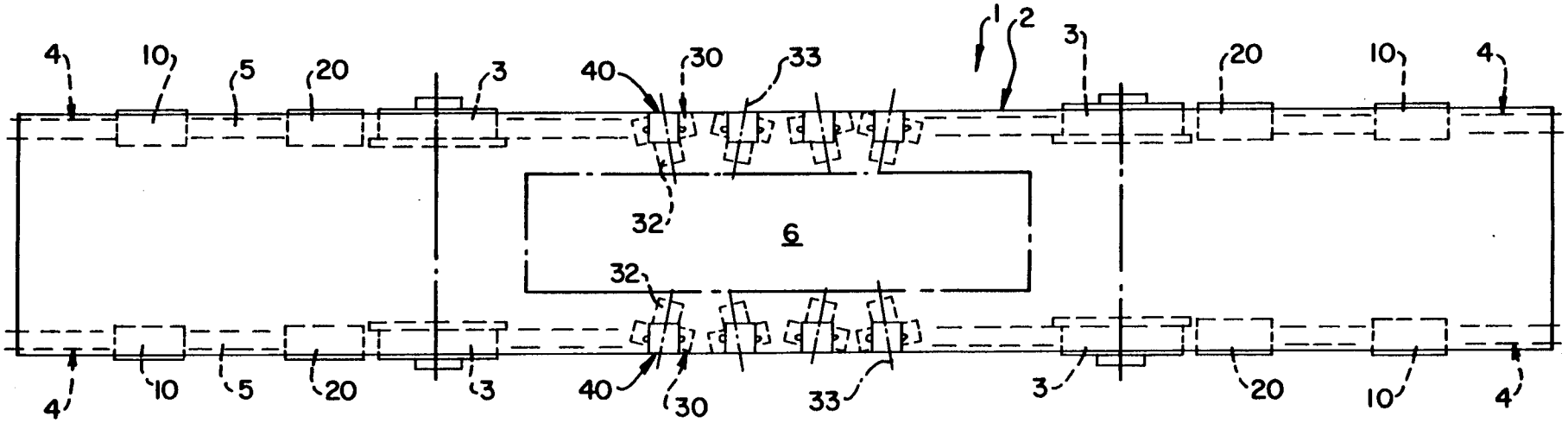
FIG. 4 is a schematic top plan view of the inventive device.

It is apparent from FIGS. 1 and 4 that the rail cleaning device 1 comprises a chassis 2 supporting a plurality of wheels 3 so designed that the device 1 is a vehicle running on rails and, thus, can be driven along, for example, a railway, the two rails of which are designated by 4.

The device 1 further comprises a source 6 with pressure medium in the form of for example a hydraulic oil unit comprising a Diesel engine, a hydraulic oil pump and a hydraulic oil tank. The source 6 with pressure medium supplies a plurality of pressure medium cylinders and pressure medium motors with pressure medium.

The device 1 further comprises four scraping means 10 which are articulatedly connected to the chassis 2 via slewing brackets 11, 12, a pressure medium cylinder 13 acting between the chassis and the slewing bracket 12 to enable an individual operation of each scraping means 10 between an inactive position of repose and an active working position. The scraping means 10 comprises a plurality of replaceable scraping elements 14 which are preferably formed of an elastic material, for example rubber.

The device 1 further comprises four loosening means 20 which are articulatedly connected to the chassis 2 via slewing brackets 21, 22. A pressure medium cylinder 23 is arranged to act between the slewing bracket 22 and the chassis 2 to enable an individual operation of the loosening means 20 between an inactive position of repose and an active working position. The loosening means 20 comprises a plate-shaped member 24 preferably having on its underside a plurality of applied weld beads 25 which preferably extend diagonally across the plate 24.

In the illustrative example shown, the device 1 comprises eight reversibly rotatable brush means 30 which are operable by means of a telescopic device 40 between an inactive position of repose and an active working position. The rotatable brush means 30 preferably comprise rolls provided with brushes, so-called circular brushes which preferably comprise a plurality of brush wires 31 of metal, for example steel, or of a plastic material. However, it should be appreciated that other suitable brush means are also possible to use. A pressure medium motor 32, for example a hydraulic motor, is arranged at each brush means 30, which motor is reversibly rotationally operable so that each brush means 30 can be rotated as desired in an arbitrary direction about its rotary shaft 33. In order to obtain the best possible cleaning result for the rail, the brush means 30 are somewhat inclined so that the sweeping direction of the brush means deviate a little (for example 10°) from the longitudinal direction of the rail, this inclination preferably being varied in different directions, as best apparent from FIG. 4.

Figure 5:
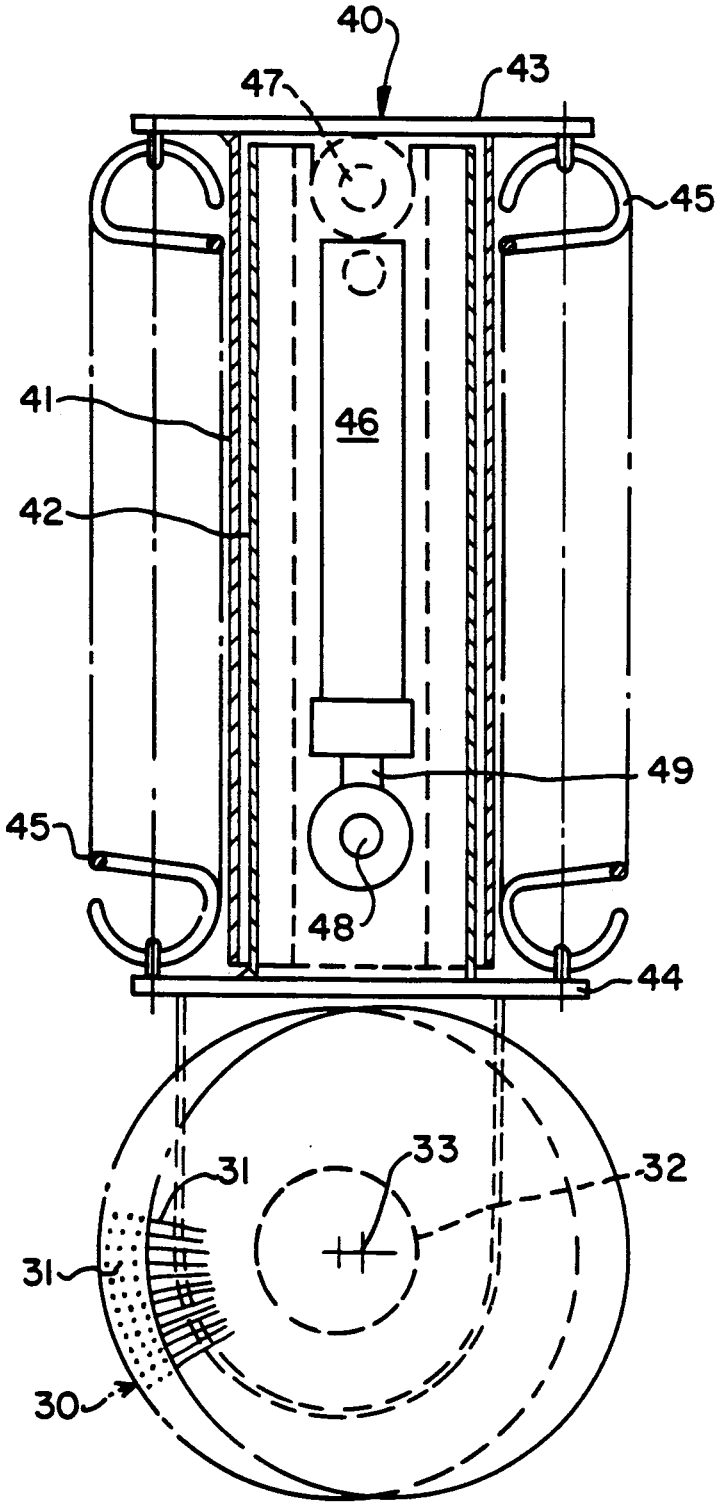
FIG. 5 is a schematic vertical longitudinal section of a unit carrying the brush means in an exposed position, on a larger scale.

The brush means 30 are carried by a telescopic device 40, the structure of which is shown more closely in FIG. 5. The telescopic device 40 comprises an outer tube 41, preferably having a rectangular form and an inner tube 42 of a corresponding form. The outer tube 41 is sealed at its upper end by means of a plate 43 and the inner tube 42 is sealed at its lower end by means of a plate 44. The outer tube 41 is placed at the chassis 2 of the device, as indicated in FIGS. 1 and 4. About the rotary shaft 33, the brush means 30 is rotatably connected to the plate 44, and the pressure medium motor 32 is also supported by the plate 44. Means exerting force in the form of, for example, tensile springs 45 act between the plate 43 and the plate 44. These tensile springs always tend to contract the telescopic device 40 to the position in FIGS. 1 and 5, where it is brought together and, thus, the brush means are in a hoisted inactive position. Within the telescopic device 40, there is arranged a pressure medium cylinder 46, the cylinder of which is disposed at the outer tube 41 (at 47) and the piston rod 49 of which is connected to the inner tube 42 (at 48). Of course, the tubes 41 and 42 have recesses enabling the connections and enabling, upon activation of the cylinder 46, that its piston rod 49 can move outwards from the cylinder and expand the telescopic device 40, so that the brush means 30 can be set at the desired contact pressure against the top surface 5 of the rail 4, this brush means 30 being in its active working position. When the telescopic device 40 is again to be moved to contracted position, the pressure on the cylinder 46 is unloaded, and the springs 45 will be able to contract the telescopic device to the position shown in FIGS. 1 and 5. As to the cylinder 46, this can thus, if desired, be single-acting with or without spring return, but the cylinder 46 can also be double-acting, there being a possibility of omitting the tensile springs 45 and, thus, also using the cylinder 46 for bringing together the telescopic device. Another possibility is to have the dead weight of the brush means, the hydraulic motor and the inner tube of the telescopic device, etc. expand the telescopic device, a pressure medium cylinder being used for contracting the telescopic device and optionally adjusting the contact pressure of the brush means against the top surface of the rail. Thus, there are several alternatives, and, of course, it is also possible to place the cylinder or cylinders outside the outer tube 41 and to place one or more tensile springs within the inner tube 42.

The device 1 of the invention operates and functions as follows. It is as feasible to use the device 1 in both directions of travel and to tow it along the railway rail by means of, for example, a locomotive, but, of course, there is also a possibility of making the device run by itself, by providing it with a driving motor driving its wheels.

Figure 2:
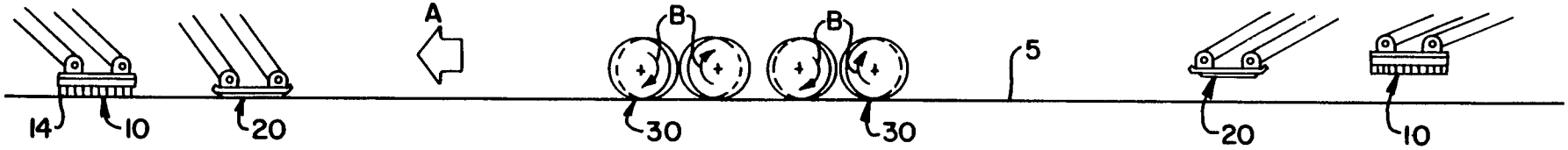
FIG. 2 shows schematically the mode of operation of the device in a first direction of travel.

FIG. 2 shows schematically how the device 1 operates when propelled in the direction of travel according to the arrow A, two of the scraping means 10, two of the loosening means 20 and the eight brush means 30 being set at a suitable pressure against the top surface 5 of the rails 4. The brush means 30 are preferably rotated in the direction of the arrows B. The rubber scrapers 14 of the scraping means 10 scrape the top surface 5 of the rail when the rail is wet. This means that the scraping means 10 need only be used when a wet rail is present. The loosening means 20 will loosen encrustment occurring on the top surface 5 of the rail so that this encrustment will be loosened from the rail as much as possible. The rotary brush means 30 will sweep off the particles lying on the rail so that the top surface 5 of the rail will be efficiently cleaned, the brush means sweeping diagonally across the rail in different directions.

Figure 3:
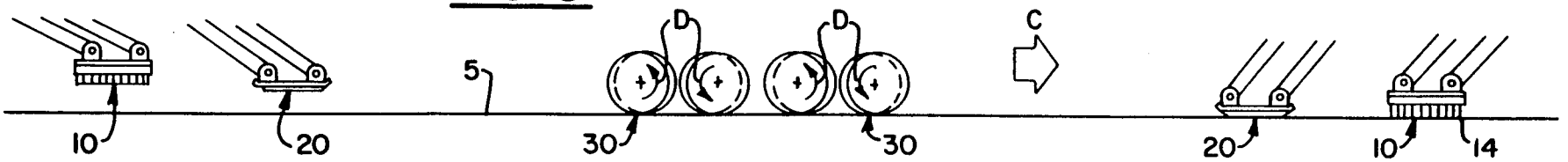
FIG. 3 shows schematically the mode of operation of the device in a second direction of travel.

FIG. 3 shows the mode of operation of the device 1 when propelled in a direction of travel according to the arrow C, two of the scraping means 10, two of the loosening means 20 and the eight brush means 30 being set at a suitable pressure against the top surface 5 of the rails 4. The brush means 30 are preferably rotated in a direction according to the arrows D.

The scraper means 10 and the loosening means 20 are so arranged that they can spring away without any detrimental influence on the device 1 if they run across an obstacle on the rail enforcing such springing away.

It should be pointed out that protective shields should be arranged at the brush means, but such protective details, hydraulic lines and the like have not been shown on the drawings in order to eliminate confusing detail.

It will be appreciated that the scraping, loosening and brush means can be operated in another way than shown here, for instance by electrically actuated operating means instead of such means actuated by a pressure medium.

It will also be appreciated that there is a possibility of adjusting individually a contact pressure on each scraping, loosening and brush means.

Thus, the invention is not restricted to what has been shown and described, but amendments and modifications thereof are possible within the scope of the following claims.

I claim:

1. Apparatus for cleaning plant debris from running surfaces of railway rails, comprising:

a chassis provided with a set of wheels for running longitudinally in both directions on a set of two laterally spaced railway rails having respective upwardly presented running surfaces;

for operative contact with the running surface of each rail, a respective brush set each comprising at least one brush and means for rotating each such brush about a generally horizontal axis arranged generally transverse to said directions;

for operative contact with the running surface of each rail, two looseners, one leading the respective said brush set in one of said directions and the other leading the respective said brush set in the other of said directions;

for operative contact with the running surface of each rail, two scrapers, one leading the respective said loosener in one of said directions and the other leading the respective said loosener in the other of said directions;

means supported on said chassis for raising and lowering the brushes of said brush sets out of and into operative contact with said running surfaces of said rails; and means supported on said chassis for raising and lowering said looseners out of and into operative contact with said running surfaces of said rails, this means being operable to lower those of said looseners which lead said brushes in a selected said direction of travel of said chassis along said rails, and raise those of said looseners which trail said brushes in said selected said direction of travel of said chassis along said rails;

means supported on said chassis for raising and lowering said scrapers out of and into operative contact with said running surfaces of said rails, this means being operable to lower those of said scrapers which lead ones of said looseners that are disposed in engagement with said running surfaces, and raise those of said scrapers which trail ones of said looseners that are disposed out of engagement with said running surfaces.

2. The apparatus of claim 1, wherein:

said set of wheels includes at least two wheels disposed for engaging the running surface of one of said rails, and at least two wheels disposed for engaging the running surface of the other of said rails; and each brush set is disposed longitudinally intermediate a respective said two of said wheels.

3. The apparatus of claim 2, wherein:

each scraper comprises a plate of rubber scraper elements.

4. The apparatus of claim 2, wherein:

each loosener comprises a metal plate bearing a plurality of downwardly presented weld beads arranged to engage a respective said running surface at angles oblique to said directions.

5. The apparatus of claim 2, wherein:

each said brush set comprises at least two brushes and said means for rotating said brushes comprising means for counter-rotating each said two brushes.

6. The apparatus of claim 5, wherein:

each said generally horizontal axis is disposed generally obliquely of transverse to said directions.

7. The apparatus of claim 1, wherein:

each said brush comprises a roll having projecting wire bristles.

8. The apparatus of claim 1, wherein:

said means for raising and lowering said brushes comprises respective extensible-retractable telescopic support devices; and means for extending and retracting said telescopic support devices.

9. The apparatus of claim 1, wherein:

said means for raising and lowering said looseners comprises respective slewing brackets; and means for slewing said slewing brackets relative to said chassis.

10. The apparatus of claim 1, wherein:

said means for raising and lowering said scrapers comprises respective slewing brackets; and means for slewing said slewing brackets relative to said chassis.

* * * * *